US011008774B2

(12) United States Patent
Shi et al.

(10) Patent No.: US 11,008,774 B2
(45) Date of Patent: May 18, 2021

(54) FENCE SYSTEM

(71) Applicant: HEFEI WISDOM BRIDGE INFORMATION TECHNOLOGY CO., LTD., Anhui (CN)

(72) Inventors: Kan Shi, Anhui (CN); Ruomei Li, Anhui (CN)

(73) Assignee: Hefei Wisdom Bridge Information Technology Co., Lt, Hefei (CN)

( * ) Notice: Subject to any disclaimer, the term of this patent is extended or adjusted under 35 U.S.C. 154(b) by 0 days.

(21) Appl. No.: 17/138,877

(22) Filed: Dec. 30, 2020

(65) Prior Publication Data

US 2021/0115696 A1 Apr. 22, 2021

Related U.S. Application Data

(63) Continuation of application No. PCT/CN2019/109776, filed on Sep. 30, 2019.

(51) Int. Cl.
*E04H 17/06* (2006.01)
*E04H 17/10* (2006.01)
*E01F 13/02* (2006.01)

(52) U.S. Cl.
CPC ..... *E04H 17/06* (2013.01); *E01F 13/02* (2013.01); *E04H 17/124* (2021.01)

(58) Field of Classification Search
CPC ..... E04H 17/02; E04H 17/04; E04H 17/05; E04H 17/06; E04H 17/08; E04H 17/10; E04H 17/12; E04H 17/124; E04H 17/127; E04H 17/133; E04H 17/135; E04H 17/139; E01F 13/02; E01F 13/022; E01F 13/024; E01F 13/028
See application file for complete search history.

(56) References Cited

U.S. PATENT DOCUMENTS 4,119,301 A * 10/1978 Payne ..... E04H 17/10 256/1
5,029,819 A * 7/1991 Kane ..... E04H 17/04 256/24
6,089,302 A * 7/2000 Britt ..... E06B 9/08 160/28

(Continued)

FOREIGN PATENT DOCUMENTS

CN 201121435 Y 9/2008
CN 205422154 U 8/2016

(Continued)

*Primary Examiner* — Jonathan P Masinick

(57) ABSTRACT

The present invention discloses a fence system, which is composed of a plurality of assembly units that are detachably connected in sequence. Each assembly unit includes a base, a fixed assembly, a winding apparatus, an outer bar body and a net body. The winding apparatus is fixed on the top of the base, located in the outer bar body and used to drive the outer bar body to rotate around the base, so that the net body is wound on the outer side of the outer bar body. The fixed assembly is retracted into the base or unfolded and fixed on the bottom of the base. The present invention realizes convenience in disassembling and assembling, realizes the automatic winding of the net body, thereby facilitating the transfer and reuse of the assembly units; and enhances the stability of the assembly units and the overall structure and achieving good practicability.

12 Claims, 9 Drawing Sheets

(56) References Cited

U.S. PATENT DOCUMENTS 6,536,502 B2 * 3/2003 Britto ..... E06B 9/08 160/23.1
6,807,999 B1 * 10/2004 Bowen ..... E01F 13/028 160/24
7,297,079 B1 * 11/2007 Delauter ..... A63B 61/02 273/349
8,087,443 B2 * 1/2012 Snyder ..... E06B 9/08 160/29
8,573,565 B1 * 11/2013 Lyndaker ..... E04H 17/161 256/23
9,175,450 B2 * 11/2015 Weiner ..... E01F 13/028
9,433,308 B1 * 9/2016 Kalinski ..... A47G 5/02
9,598,896 B1 * 3/2017 Pichik ..... E06B 9/13
9,890,506 B2 * 2/2018 Weiner ..... B65H 75/48
10,035,677 B2 * 7/2018 Chen ..... E01F 13/028
10,100,574 B2 * 10/2018 Reiner ..... E06B 3/4636
10,316,479 B2 * 6/2019 Green ..... E01F 13/06
10,513,870 B1 * 12/2019 Jackson ..... E01F 13/022
10,738,529 B1 * 8/2020 Daley ..... E06B 9/18
10,794,022 B2 * 10/2020 Reiner ..... B65H 75/48
2003/0164485 A1 * 9/2003 Olson ..... B21F 33/002 256/37
2007/0193705 A1 * 8/2007 Hsu ..... A47G 5/02 160/238
2008/0121352 A1 * 5/2008 Cheng ..... E06B 9/08 160/238
2010/0028598 A1 * 2/2010 Soofer ..... E04H 17/16 428/138
2015/0308058 A1 * 10/2015 Boyce ..... E04H 12/2253 256/32
2017/0038004 A1 * 2/2017 Kalinski ..... F16P 1/02
2017/0268189 A1 * 9/2017 Heinevik ..... E01F 15/06
2018/0044868 A1 * 2/2018 Miller ..... E04H 17/00

FOREIGN PATENT DOCUMENTS

CN 206329142 U 7/2017
CN 207177450 U 4/2018
CN 207211948 U 4/2018
CN 108179918 A 6/2018
CN 109577739 A 4/2019
JP 2000061025 A 2/2000

* cited by examiner

FENCE SYSTEM

CROSS-REFERENCE TO RELATED APPLICATIONS

This application is a continuation of International Patent Application No. PCT/CN2019/109776, filed on Sep. 30, 2019. The content of the aforementioned applications, including any intervening amendments thereto, is incorporated herein by reference in its entirety.

TECHNICAL FIELD

The present invention relates to the technical field of electric power construction equipment, and particularly relates to a fence system.

BACKGROUND OF THE PRESENT INVENTION

At present, in order to meet the safety requirement in the construction or maintenance process of electric power, protective fences must be erected on construction sites so as to effectively prevent non-construction personnel from entering the construction or maintenance site of the electric power.

The existing electric power protective fence is generally composed of a left vertical bar, a right vertical bar and a protective mechanism (generally a protective net) arranged between the two vertical bars. The protective net is connected with the two vertical bars through hanging, rope fastening and the like. Although the above structure has certain warning effect, there are a lot of disadvantages in an actual application process because of structural and design limitations.

Firstly, by adopting the connection way such as hanging, rope fastening and the like, the protective net is infirm in connection and difficult to fix, and is easy to loosen and drop off, so that an ideal protection effect cannot be achieved.

Secondly, when the vertical bars and the protective net are disassembled after used, the operation is complicated, thereby wasting time and labor; and moreover, the protective net and the vertical bars are stacked and transferred after separated, which is easy to cause the problems such as intertwining and local knotting of the protective net, and is not conducive to the subsequent reuse.

Moreover, the existing structural design of the vertical bars cannot be flexibly adjusted according to the actual need so as to meet the fixation requirements of different support foundations on different sites, causing that the support stability of the vertical bars cannot be guaranteed.

The above greatly reduces the application performance and application range of the electric power protective fence. Therefore, it is urgent to design a novel fence system to solve the above problems.

SUMMARY OF THE PRESENT INVENTION

The technical problem to be solved by the present invention is to provide a fence system, which is composed of a plurality of assembly units that are detachably connected in sequence, thereby realizing convenience in disassembling and assembling. The fence system has an automatic winding function, thereby facilitating the transfer and reuse of the assembly units. The fence system can meet the ground fixation requirements of different working sites, and enhances the stability of the assembly units and the overall structure.

To solve the above technical problem, the present invention adopts a technical solution as follows: a fence system is provided, which is composed of a plurality of assembly units that are detachably connected in sequence. Each assembly unit includes a base, a fixed assembly, a winding apparatus, an outer bar body and a net body.

The winding apparatus is fixed on the top of the base, located in the outer bar body and used to drive the outer bar body to rotate around the base, so that the net body is wound on the outer side of the outer bar body.

The fixed assembly is retracted into the base or unfolded and fixed on the bottom of the base.

Further, the winding apparatus includes a driving unit fixed on the top of the base, an electric motor fixed on the top of the driving unit, and a rotating disc fixed on the end of an output shaft on the top of the electric motor.

The rotating disc is fixedly connected with the outer bar body.

Further, the outer side of the base is sleeved with a wire protection sleeve. The bottom of the inner wall of the outer bar body is rotatably connected to the outer side of the wire protection sleeve through a bearing.

Further, the fixed assembly includes a compression spring connected to the inner top surface of the base, a movable plate connected to the bottom end of the compression spring, and a plurality of fixed claws rotatably connected to the bottom surface of the movable plate.

The side surface of the movable plate slidably contacts the inner wall of the base.

Further, the inner wall of the fixed claw is provided with a fastening bolt. The bottom surface of the base is provided with a threaded hole matched with the fastening bolt.

Further, the bottom of the base is provided with an anchor tip housing of a conical structure.

Further, an inner bar body is slidably plugged in the outer bar body.

The side wall of the inner bar body is provided with a plurality of plugging bayonets in a vertical direction.

The side wall of the outer bar body is provided with a strip-shaped through hole located at the outer side of the plugging bayonets.

Further, the top of the side wall of the outer bar body is provided with at least one locking screw. The inner end of the locking screw is abutted against the outer wall of the inner bar body.

Further, the top of the inner bar body is provided with a top cover.

The top surface of the top cover is provided with a first connecting boss. The top of the first connecting boss is provided with a lifting handle.

Further, the net body includes a flexible net rim fixed on the outer wall of the outer bar body, and flexible wires that are connected in the flexible net rim and interwoven with one another.

The side edge of the flexible net rim away from the outer bar body is provided with a plurality of plugging buckles.

The present invention has the beneficial effects as follows:

1. The present invention adopts an assembling mode in which a plurality of assembly units are connected by the buckles, thereby realizing convenience in assembling and disassembling, and greatly enhancing the working efficiency for constructing a protective net.

2. The present invention is provided with the winding apparatus which drives the outer bar body to rotate so as to realize the automatic winding of the net body, thereby facilitating the disassembling and storage operation of the protective net, effectively avoiding the random intertwining of the net bodies and facilitating the reuse.

3. The present invention can meet the ground fixation requirements of different working sites by installing a fixed assembly that can be folded for storage and unfolded for fixation in the base, thereby enhancing the stability of the assembly units and the overall structure, reducing the tilting and falling probability caused by an external force such as the wind force, and achieving good practicability.

Figure 1:
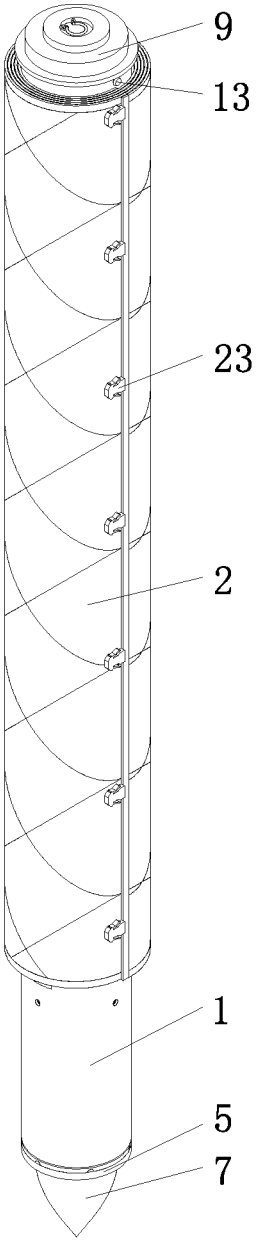
FIG. 1 is a three-dimensional structural schematic diagram of a net body in a wound state according to the present invention.

In the drawings: 1—outer bar body; 11—first plugging bayonet; 12—strip-shaped through hole; 13—locking screw; 2—net body; 21—flexible net rim; 22—flexible wire; 23—plugging buckle; 3—fixed assembly; 31—compression spring; 32—movable plate; 33—fixed claw; 34—fastening bolt; 4—winding apparatus; 41—driving unit; 42—electric motor; 43—rotating disc; 5—base; 51—second connecting boss; 52—embedding opening; 53—threaded hole; 6—wire protection sleeve; 61—wiring groove; 7—anchor tip housing; 8—inner bar body; 81—plugging buckle; 9—top cover; 91—first connecting boss; 92—lifting handle; 100—support foundation.

DETAILED DESCRIPTION OF THE PRESENT INVENTION

Preferred embodiments of the present invention are described in detail below in conjunction with the drawings to make the advantages and features of the present invention more easily understood by those skilled in the art, so as to define the protection scope of the present invention more clearly.

The specific structure and working principle of the present invention are described in detail below through two specific embodiments and three use states of one specific embodiment.

Embodiment I

Figure 2:
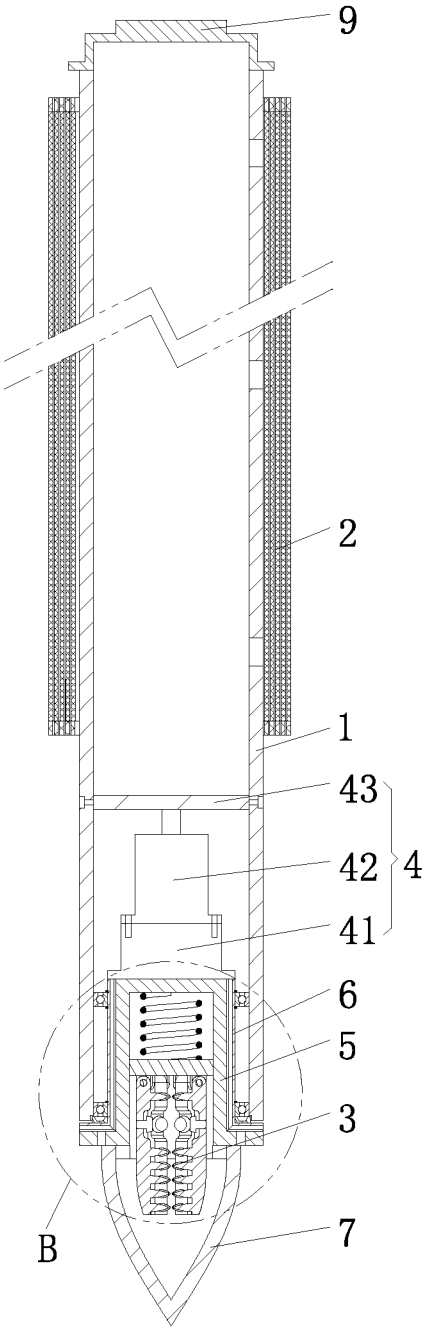
FIG. 2 is a sectional structural schematic diagram of embodiment I of the present invention.

Referring to FIG. 1 and FIG. 2, a fence system is composed of a plurality of assembly units that are detachably connected in sequence. Each assembly unit includes a base 5, a fixed assembly 3, a winding apparatus 4, an outer bar body 1 and a net body 2.

Figure 4:
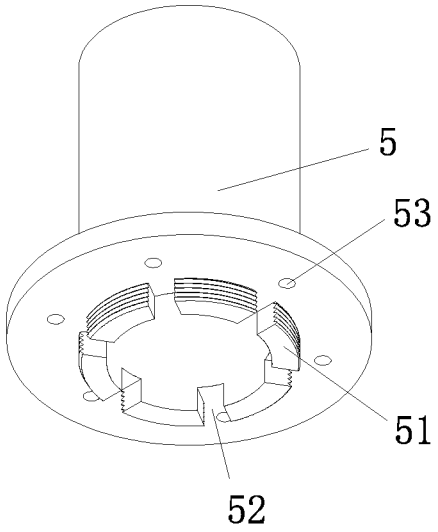
FIG. 4 is a three-dimensional structural schematic diagram of a base.

As shown in FIG. 4, the base 5 is of a cylindrical shell structure with an inverted-U-shaped cross section. The bottom surface of the base 5 is provided with an annular second connecting boss 51, and a circumferential surface of the second connecting boss 51 is provided with outer threads. The side wall of the second connecting boss 51 is provided with six embedding openings 52 that are uniformly distributed.

The bottom of the base 5 is provided with an anchor tip housing 7 of a conical structure. The anchor tip housing 7 is a shell structure made of a metal material. The inner wall of the anchor tip housing is provided with inner threads that are correspondingly connected with the outer threads on the second connecting boss 51. The conical structure of the anchor tip housing 7 is convenient for integrally plugging and fixing the protective net on a loose support foundation such as wetland, sand and the like.

Figure 5:
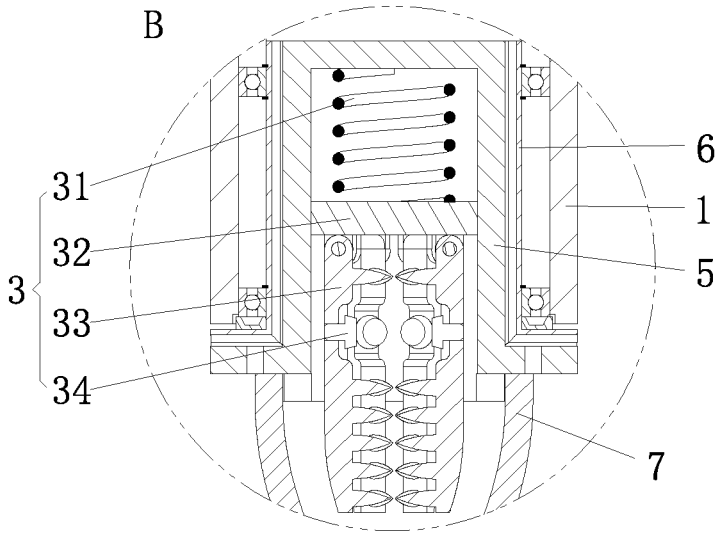
FIG. 5 is an enlarged structural schematic diagram of a part B in FIG. 2.

The fixed assembly 3 is retracted into the base 5 or unfolded and fixed on the bottom of the base 5. As shown in FIG. 5, the fixed assembly 3 includes a compression spring 31 connected to the inner top surface of the base 5, a movable plate 32 connected to the bottom end of the compression spring 31, and six fixed claws 33 rotatably connected to the bottom surface of the movable plate 32. The side surface of the movable plate 32 slidably contacts the inner wall of the base 5, so that the six fixed claws 33 can be integrally retracted into the base 5 after being drawn close, and limited in the base 5 by the anchor tip housing 7 that is connected to the bottom of the base 5 by the threads, and the compression spring 31 is then in a compressed state.

Figure 6:
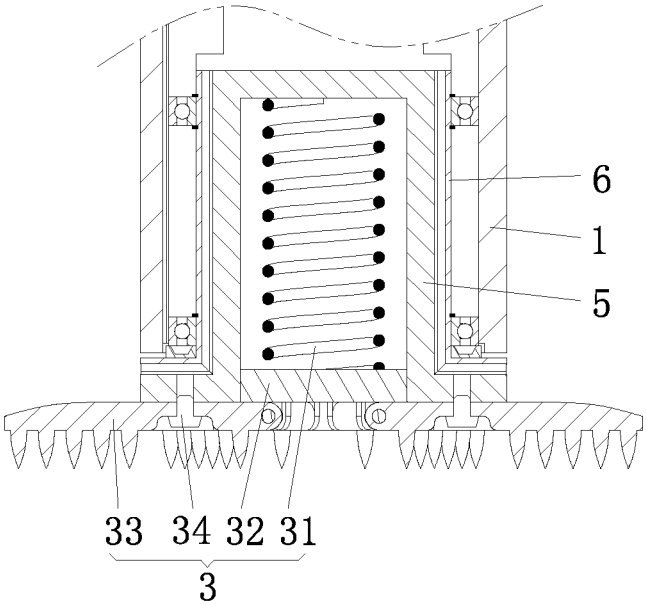
FIG. 6 is a structural schematic diagram of a fixed assembly in an unfolded state of fixed claws.

After the anchor tip housing 7 is removed from the base 5, the movable plate 32 and the six fixed claws 33 are pushed out to the bottom outer side of the base 5 under the effect of a restoration force of the compression spring 31. As shown in FIG. 6, the six fixed claws 33 are correspondingly located in the six embedding openings 52 after being unfolded outwards to a horizontal state. Preferably, the inner wall of the fixed claw 33 is provided with a fastening bolt 34. The bottom surface of the base 5 is provided with a threaded hole 53 matched with the fastening bolt 34. After the fixed claws 33 are unfolded to the horizontal state, the fixed claws 33 are fixed on the bottom of the base 5 through the threaded connection between the fastening bolt 34 and the threaded hole 53, thereby increasing a support area of the bottom of the base 5 and enhancing the overall support stability of the base 5.

Further, the inner wall/bottom surface of the fixed claw 33 is provided with a plurality of spike structures, which can effectively enhance a grasping force between the fixed claws 33 and the support foundation, thereby improving the support stability and reliability. Meanwhile, the inner wall/bottom surface of the fixed claw 33 is provided with a groove, and the fastening bolt 34 is arranged in the groove, so that after the fastening bolt 34 is connected with the threaded hole 53 of the base 5, the fastening bolt 34 is sunken into the groove without influencing the flatness of the support surface of the fixed claw 33.

Figure 3:
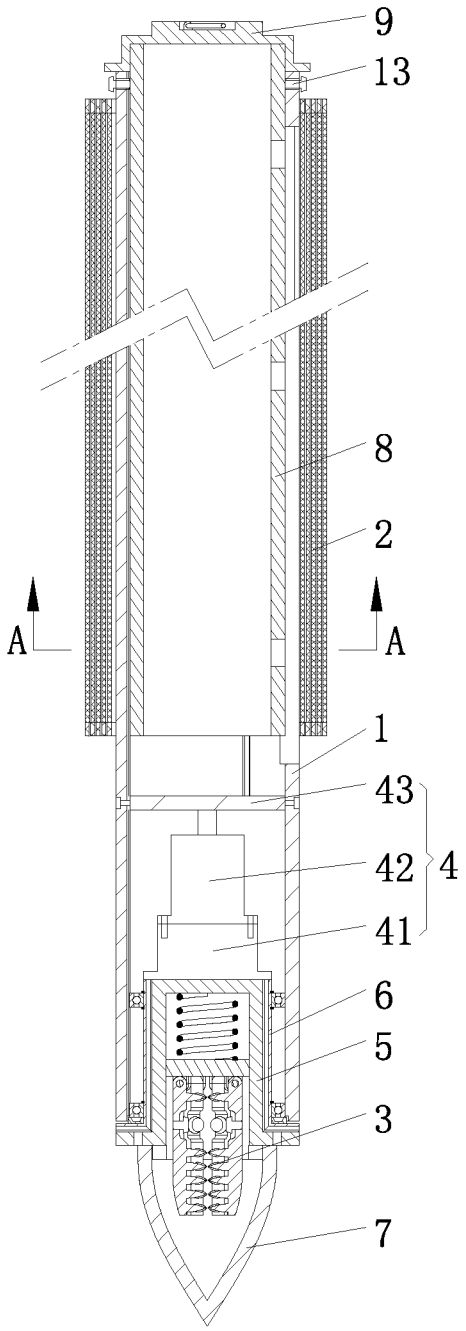
FIG. 3 is a sectional structural schematic diagram of embodiment II of the present invention.

The winding apparatus 4 is fixed on the top of the base 5, located in the outer bar body 1 and used to drive the outer bar body 1 to rotate around the base 5, so that the net body 2 is wound on the outer side of the outer bar body 1. As shown in FIG. 2 or FIG. 3, the winding apparatus 4 includes a driving unit 41 fixed on the top of the base 5, an electric motor 42 fixed on the top of the driving unit 41, and a rotating disc 43 fixed on the end of an output shaft on the top of the electric motor 42. The driving unit 41 includes an electrical box, a battery pack, a controller (not shown in the drawing) and other modules, which belongs to the prior art and is not described in detail herein. The battery pack adopts a rechargeable lithium battery pack.

Figure 7:
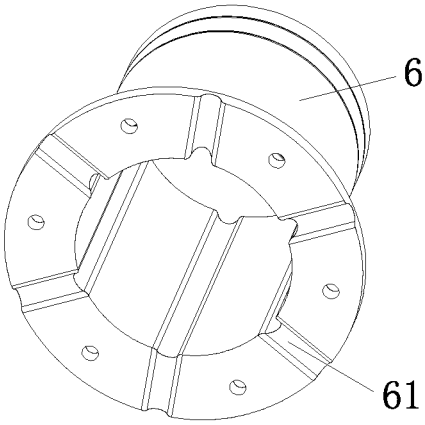
FIG. 7 is a three-dimensional structural schematic diagram of a wire protection sleeve.

Preferably, the outer side of the base 5 is sleeved with a wire protection sleeve 6. The wire protection sleeve 6 is fixedly connected with the base 5 through a bolt. As shown in FIG. 7, the inner wall and the bottom surface of the wire protection sleeve 6 are respectively provided with a communication wiring groove 61 for laying and protecting switch circuits and charging circuits of the driving unit 41. The side wall of the base 5 is provided with a switch, a power supply indicator lamp and a charging interface (not shown) which are electrically connected with the driving unit 41. The switch is used to control the on/off of the electric motor 42. The power supply indicator lamp is used to display an electric quantity of the battery pack. The charging interface is used to charge the battery pack in the driving unit 41.

The bottom of the inner wall of the outer bar body 1 is rotatably connected to the outer side of the wire protection sleeve 6 through a bearing. The side surface of the rotating disc 43 is fixedly connected with the side wall of the outer bar body 1 through a bolt. The electric motor 42 drives the rotating disc 43 to rotate, so that the outer bar body 1 is driven to rotate around the wire protection sleeve 6, and the net body 2 is wound on the outer bar body 1, thereby achieving an automatic winding function. With the wire protection sleeve 6, the winding process does not cause any damage to the circuit of the winding apparatus 4.

Figure 9:
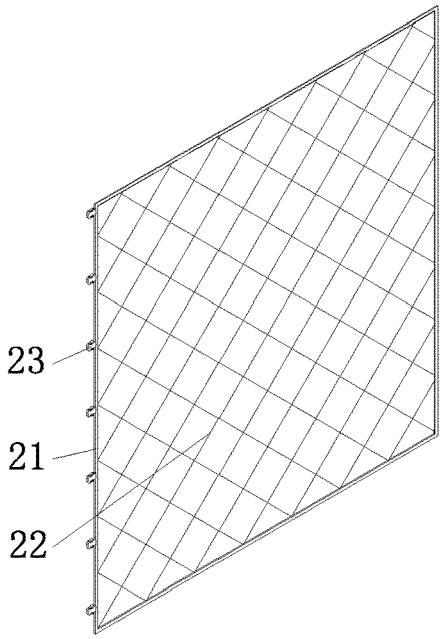
FIG. 9 is a three-dimensional structural schematic diagram of the net body in an unfolded state.
Figure 10:
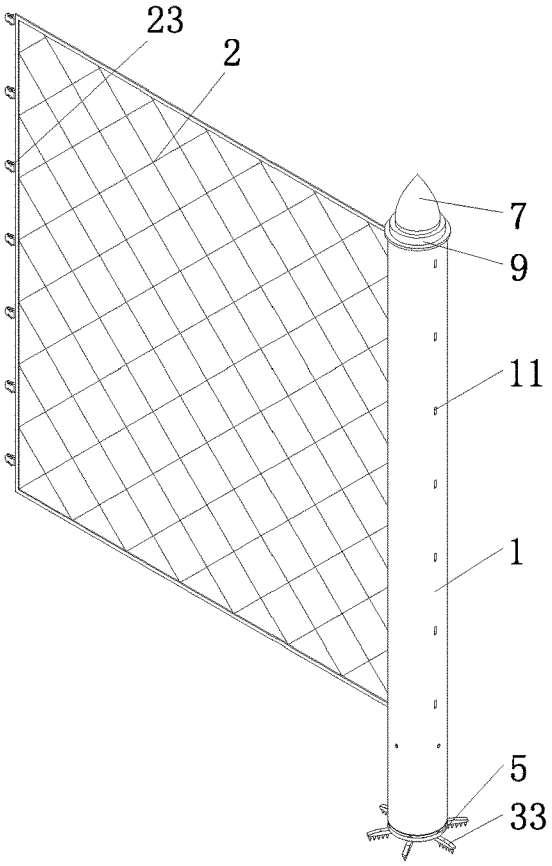
FIG. 10 is a three-dimensional structural schematic diagram of embodiment I in an unfolded state of the present invention.

As shown in FIG. 10, the side wall of the outer bar body 1 is provided with a plurality of first plugging bayonets 11 that are equally spaced in a vertical direction. As shown in FIG. 9, the net body 2 includes a flexible net rim 21 fixed on the outer wall of the outer bar body 1, and flexible wires 22 that are connected in the flexible net rim 21 and interwoven with one another. The flexible net rim 21 is made of flexible materials such as cloth, leather and the like and used to hem and sew the flexible wires 22, thereby facilitating the winding of the net body 2. The side edge of the flexible net rim 21 away from the outer bar body 1 is provided with plugging buckles 23 having the same quantity and distribution with that of the first plugging bayonets 11 for the buckling between the net body 2 of one assembly unit and the outer bar body 1 of the adjacent assembly unit. The plugging buckle 23 adopts a plastic strap buckle, which is convenient for the connection with and disassembling from the first plugging bayonet 11.

Figure 8:
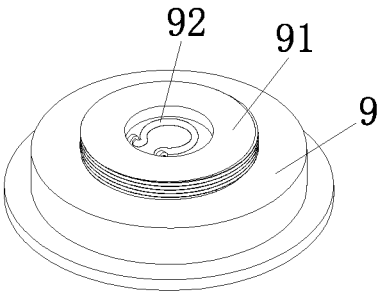
FIG. 8 is a three-dimensional structural schematic diagram of a top cover.

The top of the outer bar body 1 is fixedly provided with a top cover 9. As shown in FIG. 8, the top surface of the top cover 9 is provided with a first connecting boss 91. The first connecting boss 91 has the same outer diameter with the outer diameter of the second connecting boss 51 and is also provided with outer threads. After removed from the base 5, the anchor tip housing 7 is transferred onto the first connecting boss 91 and fixed on the first connecting boss 91 through thread connection, so that the random storage or loss of the anchor tip housing 7 can be avoided.

Embodiment II

Figure 11:
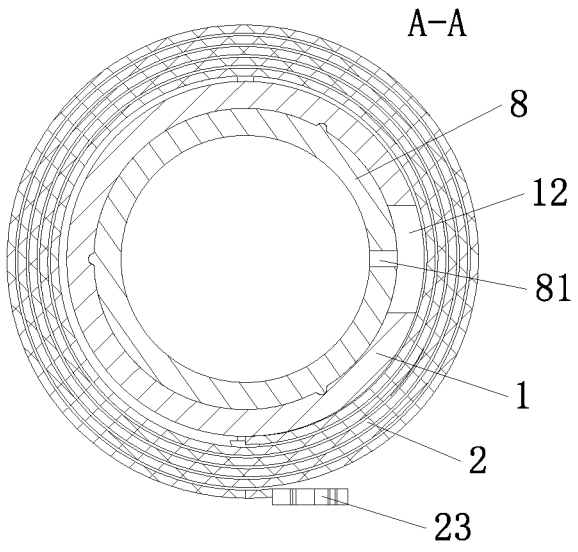
FIG. 11 is a sectional view of an A-A position in FIG. 2.

The present embodiment differs from embodiment I in that: as shown in FIG. 3, an inner bar body 8 is slidably plugged in the outer bar body 1. As shown in FIG. 11, the inner wall of the outer bar body 1 is provided with at least one guide groove in the vertical direction. The outer wall of the inner bar body 8 is provided with a guide bulge matched with the guide groove. The guide bulge is slidably embedded into the guide groove, so that the inner bar body 8 can rise and fall in the outer bar body 1 in the vertical direction. Preferably, the top of the side wall of the outer bar body 1 is provided with at least one locking screw 13. The inner end of the locking screw 13 pushes against the outer wall of the inner bar body 8. By unscrewing the locking screw 13, the inner bar body 8 is in a liftable state, so that the height of the inner bar body 8 can be adjusted. By tightening the locking screw 13, the inner bar body 8 after the position is adjusted can be fixed again on the outer bar body 1.

The top of the inner bar body 8 is fixedly provided with the top cover 9. The top surface of the top cover 9 is provided with a first connecting boss 91. The top of the first connecting boss 91 is provided with a groove. A lifting handle 92 is arranged in the groove, so that the elevation operation of the inner bar body 8 in the outer bar body 1 is facilitated.

Figure 12:
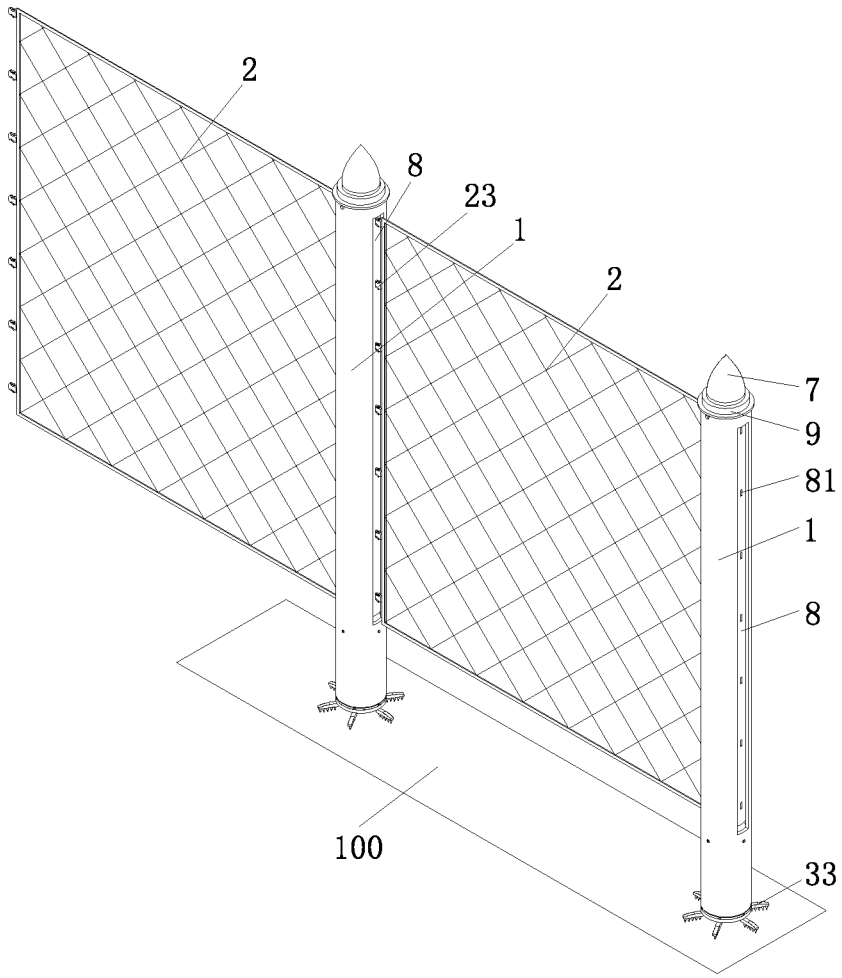
FIG. 12 is a three-dimensional structural schematic diagram of embodiment II in a use state I of the present invention.
Figure 13:
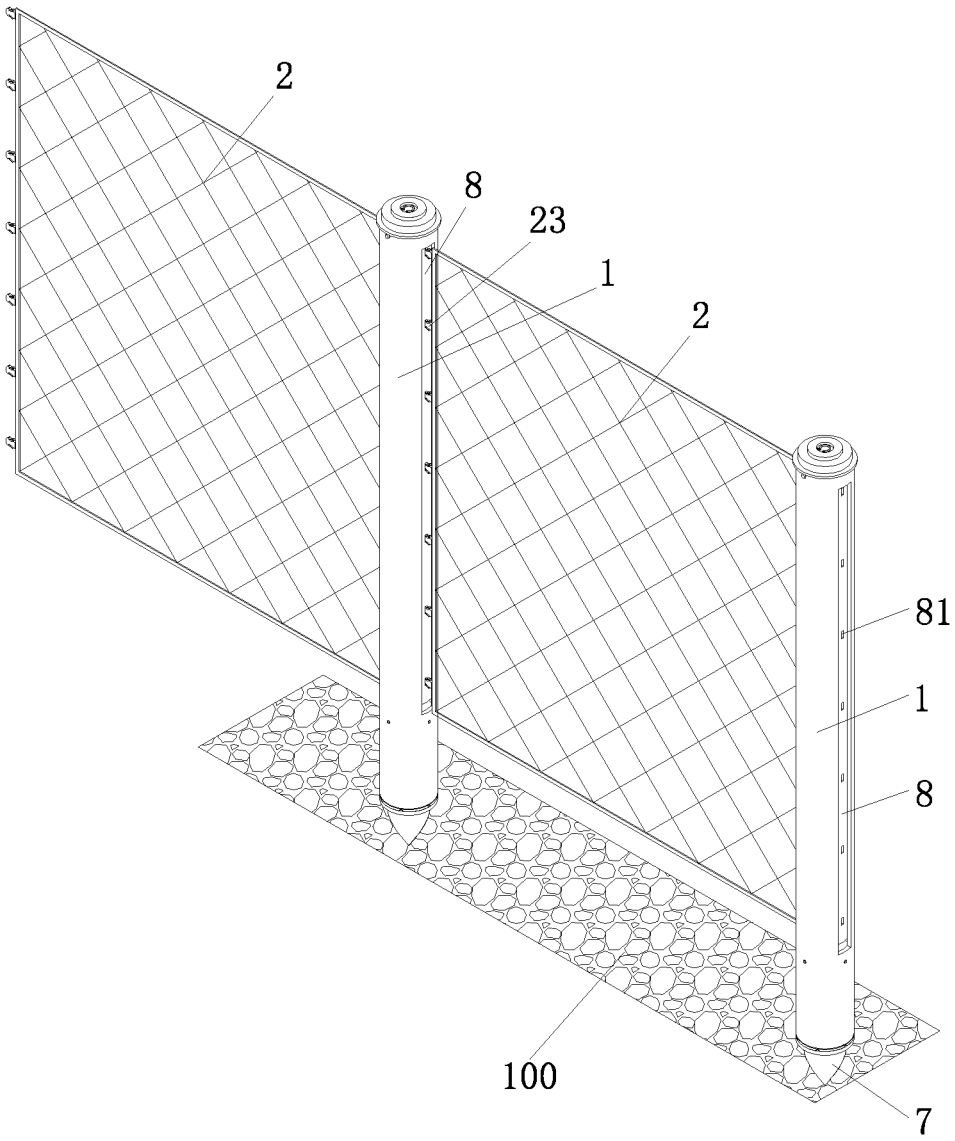
FIG. 13 is a three-dimensional structural schematic diagram of embodiment II in a use state II of the present invention.
Figure 14:
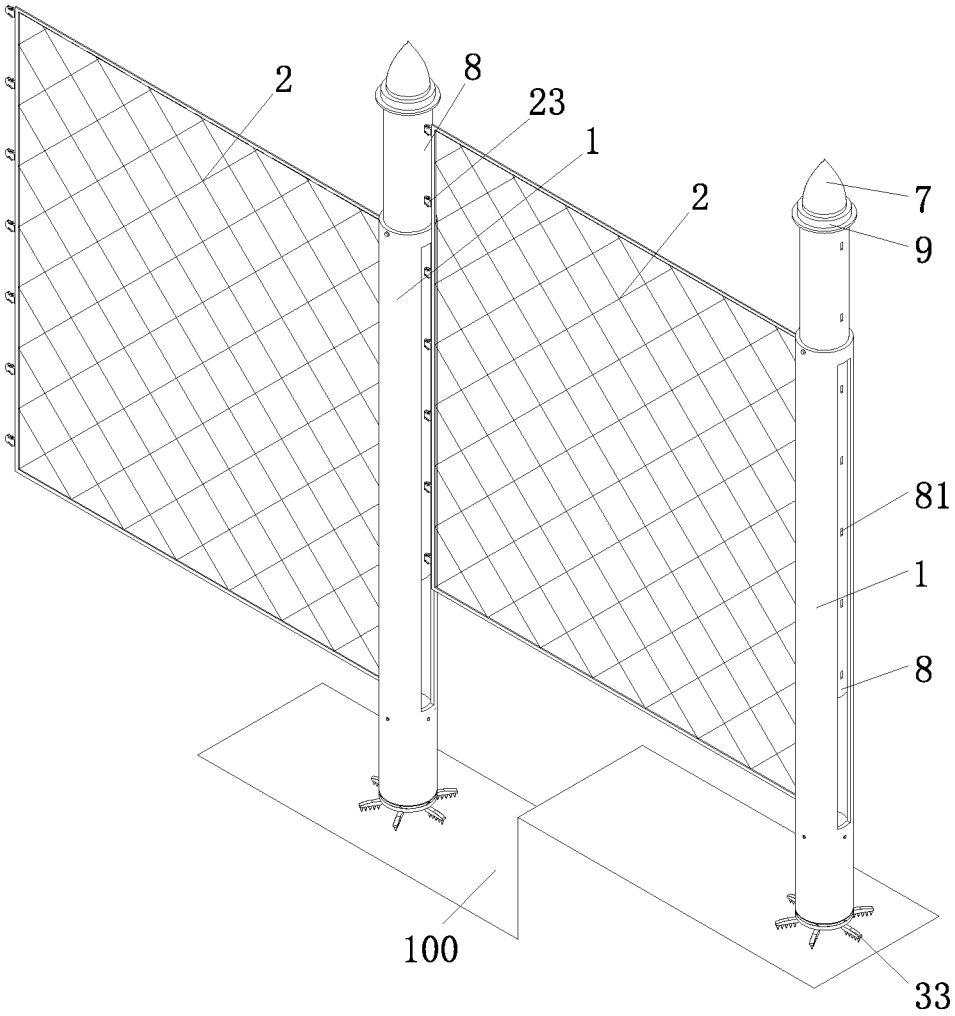
FIG. 14 is a three-dimensional structural schematic diagram of embodiment II in a use state III of the present invention.

Further, as shown in FIG. 12 to FIG. 14, the side wall of the inner bar body 8 is provided with second plugging bayonets 81 with quantity and distribution matched with the plugging buckles 23 on the net body 2 in the vertical direction for buckling connection between the net body 2 of one assembly unit and the inner bar body 8 of the adjacent assembly unit. At the same time, the side wall of the outer bar body 1 is provided with a strip-shaped through hole 12 located at the outer side of the second plugging bayonet 81, thereby facilitating the connection and disassembling between the plugging buckles 23 and the second plugging bayonets 81.

A specific application method of a protective net railing of embodiment II is described in detail below with the following three different application fields (use states):

Application occasion I: as shown in FIG. 12, the protective net is constructed on a loose support foundation 100 such as wetland, sand and the like.

(1) The anchor tip housing 7 on the bottom of the base 5 is plugged into the support foundation 100, thereby realizing the integral fixation of the base 5 and the protective net railing.

(2) The outermost end of the net body 2 is pulled to make the outer bar body 1 rotate, thereby completing an unfolding operation of the net body 2.

(3) After the net body 2 is unfolded, the plugging buckles 23 are buckled with the second plugging bayonets 81 of the previous assembly unit.

(4) A plurality of assembly units are fixed and connected in sequence to complete the construction of the overall protective net.

(5) After the use, the plugging buckles 23 of each assembly unit are separated from the corresponding second plugging bayonets 81, and the switch on the side surface of the base 5 is pressed manually to start the electric motor 42. The electric motor 42 drives the outer bar body 1 to rotate, and the net body 2 is automatically wound on the outer bar body 1, thereby completing a winding process of the net body 2 of each assembly unit.

(6) After the winding, each assembly unit is arranged on transfer equipment, which is convenient for the transfer of the assembly unit.

Application occasion II: as shown in FIG. 13, the protective net is constructed on a loose or hard support foundation 100.

(1) The anchor tip housing 7 is removed from the base 5 and connected to the first connecting boss 91 of the top cover 9. At the moment, the movable plate 32 and the six fixed claws 33 are pushed out to the bottom outer side of the base 5 under the effect of a restoration force of the compression spring 31.

(2) The six fixed claws 33 are respectively overturned to the horizontal state and fixedly connected to the bottom surface of the base 5 through the fastening bolt 34.

(3) The outermost end of the net body 2 is pulled to make the outer bar body 1 rotate, thereby completing an unfolding operation of the net body 2.

(4) After the net body 2 is unfolded, the plugging buckles 23 are buckled with the second plugging bayonets 81 of the previous assembly unit.

(5) A plurality of assembly units are fixed and connected in sequence to complete the construction of the overall protective net.

(6) After the use, the plugging buckles 23 of each assembly unit are separated from the corresponding second plugging bayonets 81, and the switch on the side surface of the base 5 is pressed manually to start the electric motor 42. The electric motor 42 drives the outer bar body 1 to rotate, and the net body 2 is automatically wound on the outer bar body 1, thereby completing a winding process of the net body 2 of each assembly unit.

(7) After the winding, each assembly unit is arranged on the transfer equipment, which is convenient for the transfer of the assembly unit.

Application occasion III: as shown in FIG. 14, the protective net is constructed on a stair-shaped support foundation 100.

(1) According to the specific situation of the support foundation 100, each assembly unit is fixed by plugging the anchor tip housing 7 into the support foundation 100 or unfolding and fixing the fixed claws 33 on the bottom surface of the base 5.

(2) The height of the inner bar body 8 in the assembly unit on a lower position is adjusted to adapt to the height of the adjacent assembly unit on a higher position. After being adjusted, the inner bar body 8 is fixed on the outer bar body 1 by the locking screw 13.

(3) The outermost end of the net body 2 on the higher position is pulled to make the outer bar body 1 rotate, thereby completing the unfolding operation of the net body 2.

(4) After the net body 2 is unfolded, the plugging buckles 23 are buckled with the second plugging bayonets 81 of the assembly unit on the lower position.

(5) A plurality of assembly units are fixed and connected in sequence to complete the construction of the overall protective net.

(6) After the use, the plugging buckles 23 of each assembly unit are separated from the corresponding second plugging bayonets 81, and the switch on the side surface of the base 5 is pressed manually to start the electric motor 42. The electric motor 42 drives the outer bar body 1 to rotate, and the net body 2 is automatically wound on the outer bar body 1, thereby completing the winding process of the net body 2 of each assembly unit.

(7) The inner bar body 8 with the height being adjusted is completely re-plugged into an initial position in the outer bar body 1.

(8) After the winding, each assembly unit is arranged on the transfer equipment, which is convenient for the transfer of the assembly unit.

The above only describes the embodiments of the present invention and does not limit the patent scope of the present invention. Any equivalent structure or equivalent process transformation made by using the contents of the description and drawings of the present invention, or direct or indirect applications in other related arts shall also be included in the patent protection scope of the present invention.

What is claimed is:

1. A fence system, which is composed of a plurality of assembly units that are detachably connected in sequence, wherein each assembly unit comprises a base (5), a fixed assembly (3), a winding apparatus (4), an outer bar body (1) and a net body (2);

the winding apparatus (4) is fixed on the top of the base (5), located in the outer bar body (1) and used to drive the outer bar body (1) to rotate around the base (5), so that the net body (2) is wound on the outer side of the outer bar body (1);

the fixed assembly (3) is retracted into the base (5) or unfolded and fixed on the bottom of the base (5).

2. The fence system according to claim 1, wherein the winding apparatus (4) comprises a driving unit (41) fixed on the top of the base (5), an electric motor (42) fixed on the top of the driving unit (41), and a rotating disc (43) fixed on the end of an output shaft on the top of the electric motor (42);

the rotating disc (43) is fixedly connected with the outer bar body (1).

3. The fence system according to claim 2, wherein the outer side of the base (5) is sleeved with a wire protection sleeve (6); and the bottom of the inner wall of the outer bar body (1) is rotatably connected to the outer side of the wire protection sleeve (6) through a bearing.

4. The fence system according to claim 1, wherein the fixed assembly (3) comprises a compression spring (31) connected to the inner top surface of the base (5), a movable plate (32) connected to the bottom end of the compression spring (31), and a plurality of fixed claws (33) rotatably connected to the bottom surface of the movable plate (32);

the side surface of the movable plate (32) slidably contacts the inner wall of the base (5).

5. The fence system according to claim 4, wherein the bottom of the base (5) is provided with an anchor tip housing (7) of a conical structure.

6. The fence system according to claim 1, wherein the bottom of the base (5) is provided with an anchor tip housing (7) of a conical structure.

7. The fence system according to claim 1, wherein the side wall of the outer bar body (1) is provided with a plurality of first plugging bayonets (11) in a vertical direction.

8. The fence system according to claim 1, wherein an inner bar body (8) is slidably plugged in the outer bar body (1);

the side wall of the inner bar body (8) is provided with a plurality of second plugging bayonets (81) in a vertical direction;

the side wall of the outer bar body (1) is provided with a strip-shaped through hole (12) located at the outer side of the second plugging bayonets (81).

9. The fence system according to claim 8, wherein the top of the side wall of the outer bar body (1) is provided with at least one locking screw (13); and the inner end of the locking screw (13) is abutted against the outer wall of the inner bar body (8).

10. The fence system according to claim 9, wherein the top of the inner bar body (8) is provided with a top cover (9);

the top surface of the top cover (9) is provided with a first connecting boss (91); and the top of the first connecting boss (91) is provided with a lifting handle (92).

11. The fence system according to claim 8, wherein the top of the inner bar body (8) is provided with a top cover (9);

the top surface of the top cover (9) is provided with a first connecting boss (91); and the top of the first connecting boss (91) is provided with a lifting handle (92).

12. The fence system according to claim 1, wherein the net body (2) comprises a flexible net rim (21) fixed on the outer wall of the outer bar body (1), and flexible wires (22) that are connected in the flexible net rim (21) and interwoven with one another;

the side edge of the flexible net rim (21) away from the outer bar body (1) is provided with a plurality of plugging buckles (23).

* * * * *